US011525193B2

(12) United States Patent
Humfeld et al.

(10) Patent No.: US 11,525,193 B2
(45) Date of Patent: Dec. 13, 2022

(54) METHOD AND APPARATUS FOR MANUFACTURING CARBON FIBERS

(71) Applicant: The Boeing Company, Chicago, IL (US)

(72) Inventors: Keith Daniel Humfeld, Federal Way, WA (US); Scott Hartshorn, Snohomish, WA (US)

(73) Assignee: The Boeing Company, Chicago, IL (US)

( * ) Notice: Subject to any disclaimer, the term of this patent is extended or adjusted under 35 U.S.C. 154(b) by 104 days.

(21) Appl. No.: 17/004,399

(22) Filed: Aug. 27, 2020

(65) Prior Publication Data

US 2020/0392647 A1 Dec. 17, 2020

Related U.S. Application Data

(62) Division of application No. 15/614,453, filed on Jun. 5, 2017, now Pat. No. 10,787,755.

(51) Int. Cl.

| | |
|---|---|
| ***D01F 9/32*** | (2006.01) |
| ***D01F 9/22*** | (2006.01) |
| ***D01D 5/253*** | (2006.01) |
| ***D01D 10/04*** | (2006.01) |
| ***D01D 13/02*** | (2006.01) |

(Continued)

(52) U.S. Cl.

CPC ..... *D01F 9/22* (2013.01); *D01D 5/16* (2013.01); *D01D 5/253* (2013.01); *D01D 10/00* (2013.01); *D01D 10/0454* (2013.01); *D01D 13/02* (2013.01); *D01F 9/14* (2013.01); *D01F 9/32* (2013.01); *D01F 11/14* (2013.01); *D01D 10/0436* (2013.01); *D01F 9/12* (2013.01); *D01F 11/10* (2013.01)

(58) Field of Classification Search

None

See application file for complete search history.

(56) References Cited

U.S. PATENT DOCUMENTS

| | | | | |
|---|---|---|---|---|
| 4,031,188 A | | 6/1977 | Kohler | |
| 5,623,031 A | * | 4/1997 | Imura | C08G 59/066 525/481 |

(Continued)

FOREIGN PATENT DOCUMENTS

| | | |
|---|---|---|
| CN | 101245504 A | 8/2008 |
| CN | 102459728 A | 5/2012 |

(Continued)

OTHER PUBLICATIONS

Extended European Search Report from European Patent Application No. 18166220.6-1107, dated Sep. 21, 2018, 4 pages.

(Continued)

*Primary Examiner* — Mohammad M Ameen

(74) *Attorney, Agent, or Firm* — Haynes and Boone, LLP

(57) ABSTRACT

A method and apparatus for manufacturing a carbon fiber. Pressure is applied to a filament to change a cross-sectional shape of the filament and create a plurality of distinct surfaces on the filament. The filament is converted into a graphitic carbon fiber having the plurality of distinct surfaces. A plurality of sizings is applied to the plurality of distinct surfaces of the graphitic carbon fiber in which the plurality of sizings includes at least two different sizings.

20 Claims, 6 Drawing Sheets

(51) Int. Cl.

| | |
|---|---|
| ***D01D 5/16*** | (2006.01) |
| ***D01F 9/14*** | (2006.01) |
| ***D01D 10/00*** | (2006.01) |
| ***D01F 11/14*** | (2006.01) |
| *D01F 9/12* | (2006.01) |
| *D01F 11/10* | (2006.01) |

(56) References Cited

U.S. PATENT DOCUMENTS

| | | | | |
|---|---|---|---|---|
| 2001/0051266 | A1* | 12/2001 | Rieder | D01D 5/253 428/297.4 |
| 2003/0082378 | A1 | 5/2003 | Rieder et al. | |
| 2006/0258810 | A1* | 11/2006 | Sugiura | C08J 5/06 525/207 |
| 2013/0149523 | A1 | 6/2013 | Tsotsis | |
| 2014/0265038 | A1* | 9/2014 | Naskar | D01F 9/225 264/405 |
| 2016/0059525 | A1* | 3/2016 | Kondou | B29C 70/46 428/220 |
| 2016/0160396 | A1 | 6/2016 | Deshpande | |
| 2016/0288457 | A1* | 10/2016 | Ellis | B32B 37/14 |

FOREIGN PATENT DOCUMENTS

| | | | | |
|---|---|---|---|---|
| CN | 106350903 | A | | 1/2017 |
| CN | 106521718 | A | | 3/2017 |
| EP | 1652997 | A2 | * | 5/2006 |
| EP | 1652997 | A2 | | 5/2006 |
| EP | 2924164 | A1 | | 9/2015 |
| JP | S50 145620 | A | | 11/1975 |
| JP | H07-062060 | A | | 3/1995 |
| JP | 2002-348743 | A | | 12/2002 |
| JP | 2004-525277 | A | | 8/2004 |
| JP | 2009-293141 | A | | 12/2009 |
| JP | 2013-122105 | A | | 6/2013 |
| JP | 2013-221223 | A | | 10/2013 |
| JP | 2016-514632 | A | | 5/2016 |
| JP | 2017-536489 | A | | 12/2017 |
| RU | 2560362 | C1 | | 8/2015 |
| WO | WO 2005/012604 | A | | 10/2005 |
| WO | WO 2012/050171 | A | | 4/2012 |
| WO | WO 2014/081002 | A | | 5/2014 |
| WO | WO 2016/089645 | A1 | | 6/2016 |

OTHER PUBLICATIONS

Office Action dated Jan. 18, 2022, from corresponding Chinese application No. 201810547405.5, 18 pp.

* cited by examiner

METHOD AND APPARATUS FOR MANUFACTURING CARBON FIBERS

CROSS-REFERENCE TO RELATED APPLICATIONS

This application is a divisional of U.S. patent application Ser. No. 15/614,453, filed Jun. 5, 2017, which is hereby incorporated by reference in its entirety.

1. FIELD

The present disclosure relates generally to carbon fibers. More particularly, the present disclosure relates to a method and apparatus for manufacturing carbon fibers using polyacrylonitrile material and a flattening process.

2. BACKGROUND

Carbon fibers have high stiffness, high tensile strength, low weight, high chemical resistance, high temperature tolerance, and low thermal expansion. These properties make carbon fibers particularly useful in certain applications, including aerospace, civil engineering, military, and other types of applications. One of the most common uses of carbon fibers is in the formation of composites. For example, carbon fibers may be combined with resin to form a composite.

Typically, carbon fiber is supplied in the form of a continuous tow, which is a bundle of hundreds to thousands of individual carbon filaments. These carbon filaments are cylindrical in shape and comprised almost entirely of carbon. Carbon fibers may be derived from different types of materials including, but not limited to, polyacrylonitrile (PAN), rayon, and petroleum pitch.

One method of manufacturing carbon fibers using polyacrylonitrile (PAN) filaments includes forming a plurality of PAN filaments from PAN material, with the PAN filaments having a cylindrical shape. The PAN filaments may be spread out in a single-layered row, forming a tow band. The tow band is tensioned and heated to carbonize the PAN filaments in the tow band. The tow band may then be further tensioned and heated to graphitize the carbon filaments in the tow band.

A sizing, which is a type of coating, may be applied to the carbon fiber. The sizing may protect the carbon fiber during handling and processing and may hold the filaments of the carbon fiber together. Further, when the carbon fiber is to be used in the fabrication of a composite, the sizing may be selected based on the type of resin to be used in forming the composite. In certain situations, it may be desirable to apply multiple sizings to carbon fibers to improve the quality of the composites formed using these carbon fibers.

Additionally, design and manufacturing costs using carbon fibers manufactured through the process described above may be more expensive than desired. Some of the carbon fibers manufactured through this process may not have a desired level of stiffness. Further, the time required for carbonization and graphitization may also be longer than desired. Therefore, it would be desirable to have a method and apparatus that take into account at least some of the issues discussed above, as well as other possible issues.

SUMMARY

In one illustrative embodiment, a method is provided for manufacturing a carbon fiber. Pressure is applied to a filament to change a cross-sectional shape of the filament and create a plurality of distinct surfaces on the filament. The filament is converted into a graphitic carbon fiber having the plurality of distinct surfaces. A plurality of sizings is applied to the plurality of distinct surfaces of the graphitic carbon fiber in which the plurality of sizings includes at least two different sizings.

In yet another illustrative embodiment, a method is provided for manufacturing a carbon fiber. A polyacrylonitrile polymer is extruded through a plurality of openings of an output system to form a plurality of filaments. Each filament of the plurality of filaments is flattened using a roller system to elongate a cross-sectional shape of each filament and create a plurality of distinct surfaces on each filament. The plurality of filaments is converted into a plurality of graphitic carbon fibers, with each of the plurality of graphitic carbon fibers having the plurality of distinct surfaces. A plurality of sizings is applied to each graphitic carbon fiber of the plurality of graphitic carbon fibers in which the plurality of sizings includes at least two different sizings.

In another illustrative embodiment, an apparatus comprises a roller system, a heat system, and a plurality of surface sizing applicators. The roller system may be used to apply pressure to a filament to change a cross-sectional shape of the filament and create a plurality of distinct surfaces. The heat system may be used to convert the filament into a graphitic carbon fiber. The plurality of surface sizing applicators may be used to apply a plurality of sizings to the plurality of distinct surfaces of the graphitic carbon fiber in which the plurality of sizings includes at least two different sizings.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

Figure 1:
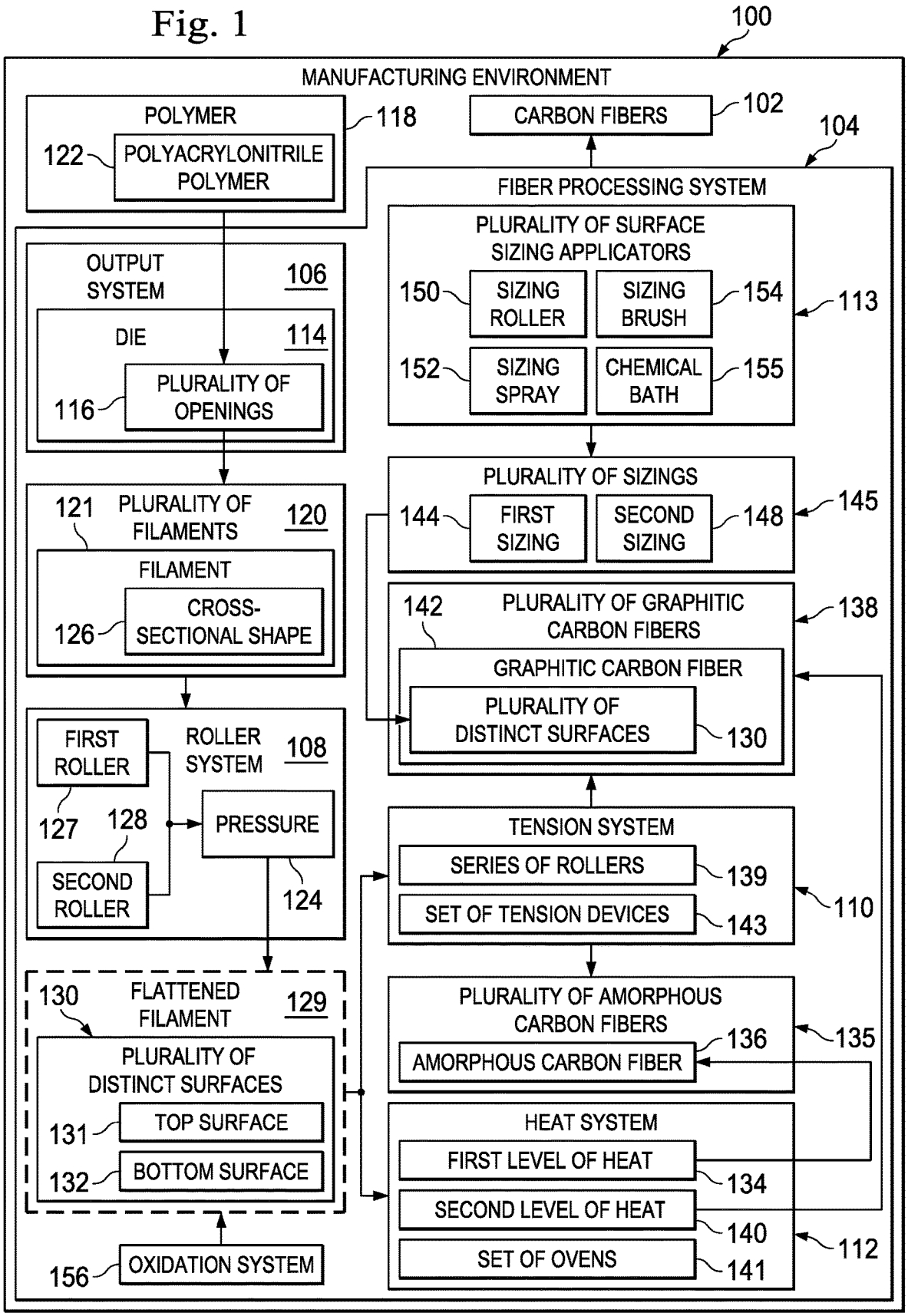
FIG. 1 is an illustration of a manufacturing environment in the form of a block diagram in accordance with an illustrative embodiment.

The illustrative embodiments recognize and take into account different considerations. For example, the illustrative embodiments recognize and take into account that it may be desirable to have a method and apparatus for manufacturing carbon fibers that allows different sizings to be applied to a single carbon fiber. In particular, it may be desirable to have a method and apparatus for manufacturing carbon fibers in a manner that reduces the overall costs associated with the design and manufacturing of parts using these carbon fibers.

Thus, the illustrative embodiments provide a method for manufacturing a carbon fiber. In one illustrative embodiment, a polymer, such as a polyacrylonitrile polymer, may be extruded through a plurality of openings of an output system to form a plurality of filaments. Pressure may be applied to each filament of the plurality of filaments to change a cross-sectional shape of each filament and create a plurality of distinct surfaces on each filament. For example, each filament may be flattened and elongated to create a plurality of distinct surfaces. The plurality of filaments may be converted into a plurality of graphitic carbon fibers, with each of the plurality of graphitic carbon fibers having the plurality of distinct surfaces. A plurality of sizings may be applied to each graphitic carbon fiber of the plurality of graphitic carbon fibers. For example, a first sizing may be applied to one surface of a graphitic carbon fiber and a second sizing may be applied to another surface of the graphitic carbon fiber. These two sizings may be applied to the graphitic carbon fiber simultaneously or at different times.

The pressure may be applied to the plurality of filaments using a roller system configured to flatten the plurality of filaments. Flattening the plurality of filaments may elongate (or flatten) the cross-sectional shape of each of the plurality of filaments. This flattening may allow filaments in the plurality of filaments to band together more densely during manufacturing. Thus, a more densely packed carbon fiber reinforced plastic (CFRP) may be formed. Further, higher part stiffness may be achieved with a more densely packed carbon fiber, which may, in turn, lead to reduced weight in composite parts fabricated using these carbon fibers.

Further, the increased surface area exposed by flattening the plurality of filaments may allow two sizings to be easily applied to the plurality of filaments. For example, a first sizing may be applied to the top surface of each of the plurality of filaments exposed by flattening. A second sizing may be applied to the bottom surface of each of the plurality of filaments exposed by flattening.

In one illustrative example, the sizings may be two different types of epoxy resins. Using these different sizings may help chemically align the tetra-functional epoxy molecules as these molecules infiltrate the space between the plurality of filaments making up the carbon fiber bed during prepregging or resin infusion. This chemical alignment may increase the uniformity of the carbon fiber. Increasing uniformity of the carbon fiber within a composite laminate, such as a carbon fiber reinforced plastic laminate, may increase the allowable mechanical properties of the composite laminate. Increasing the allowable mechanical properties of the composite laminate may decrease the amount of composite material that is needed in the manufacturing of parts. Thus, flattening the plurality of filaments prior to carbonization and graphitization may help decrease material and manufacturing costs, synergistically reduce weight, and improve overall manufacturing efficiency.

Additionally, flattening the filaments prior to carbonization and graphitization may reduce the time required for carbonization and graphitization. The time-at-temperature required for both of these steps may be determined by the conduction of heat through the thickness of a carbon fiber. Carbon fibers that have been roll-flattened have a shorter minimum distance for that conduction of heat, thereby reducing the time needed for carbonization and graphitization. Further, the reduction of time-at-temperature may reduce the manufacturing cost of carbon fibers.

Referring now to the figures and, in particular, with reference to FIG. 1, an illustration of a manufacturing environment is depicted in the form of a block diagram in accordance with an illustrative embodiment. Manufacturing environment 100 may be an environment in which carbon fibers 102 are manufactured.

In these illustrative examples, carbon fibers 102 may be manufactured using fiber processing system 104. Fiber processing system 104 may include output system 106, roller system 108, tension system 110, heat system 112, and plurality of surface sizing applicators 113. In one illustrative example, tension system 110 and heat system 112 are independent systems. In other illustrative examples, tension system 110 and heat system 112 may be combined to form a single system.

Output system 106 has plurality of openings 116. Output system 106 may take the form of, for example, die 114 having plurality of openings 116. Polymer 118 may be extruded through output system 106 and forced out of plurality of openings 116 in the form of plurality of filaments 120. In one illustrative example, polymer 118 takes the form of polyacrylonitrile (PAN) polymer 122. Accordingly, plurality of filaments 120 may also be referred to as a plurality of PAN filaments.

In this illustrative example, each of the openings of plurality of openings 116 may have a circular or near-circular shape. Thus, each filament of plurality of filaments 120 extruded from output system 106 may have a cylindrical or near-cylindrical shape. For example, plurality of filaments 120 may include filament 121. Filament 121 may have a substantially cylindrical shape such that filament 121 has cross-sectional shape 126 that is substantially circular.

Roller system 108 is used to apply pressure 124 to plurality of filaments 120 to change the cross-sectional shape of each of plurality of filaments 120 and create distinct surfaces on each filament. Pressure 124 may be applied to a filament, such as filament 121, by applying a force to the surface of the filament per unit area over which that force is distributed For example, without limitation, roller system 108 may be used to apply pressure 124 to change cross-sectional shape 126 of filament 121 and create plurality of distinct surfaces 130. Cross-sectional shape 126 may be changed from substantially circular to substantially oval, elliptical, rectangular with rounded corners, a similar flattened shape, or a more flattened shape with edges that are sharp, rounded, or both. In this manner, the flattening of filament 121 increases the exposed surface area of filament 121.

Further, flattening filament 121 creates plurality of distinct surfaces 130, thereby providing more surfaces on which to apply different sizings. For example, prior to flattening, filament 121 may have a substantially cylindrical shape with one continuous outer surface. Flattening filament 121 may create plurality of distinct surfaces 130 formed by edges that may be sharp our rounded. As one illustrative example, flattening filament 121 may create at least first surface 131 and second surface 132. In some cases, first surface 131 may take the form of a top surface and second surface 132 may take the form of a bottom surface.

Roller system 108 may be implemented in a number of different ways. In one illustrative example, without limitation, roller system 108 may include first roller 127 and second roller 128 positioned relative to each other with minimal to no gap in between these two rollers. In one illustrative example, first roller 127, second roller 128, or both may have a powder coating to protect plurality of filaments 120 and to prevent plurality of filaments 120 from sticking to these rollers.

Plurality of filaments 120 may be passed between first roller 127 and second roller 128 to create pressure 124 that flattens plurality of filaments 120. As one illustrative example, first roller 127 may be positioned above plurality of filaments 120, while second roller 128 is positioned below plurality of filaments 120. Running plurality of filaments 120 between these two rollers flattens plurality of filaments 120. For example, running filament 121 between first roller 127 and second roller 128 flattens cross-sectional shape 126 of filament 121.

The flattening of plurality of filaments 120 by roller system 108 may enable plurality of filaments 120 to form carbon fibers 102 that may be more densely packed in composite manufacturing. In particular, the flattening allows the packing density of carbon fibers in forming carbon fiber reinforced plastics to be increased. The higher packing density may improve part stiffness and strength, which may, in turn, lead to reduced weight in composites that are fabricated using these carbon fibers. In particular, the higher packing density may allow increased fiber volume within the composite without adding additional carbon fibers.

Once plurality of filaments 120 have been flattened as described above, plurality of filaments 120 may be tensioned, while applying first level of heat 134 to the plurality of filaments 120, to carbonize plurality of filaments 120. Plurality of filaments 120 may be carbonized to form plurality of amorphous carbon fibers 135. For example, filament 121 may be tensioned, while applying first level of heat 134 to filament 121, to form amorphous carbon fiber 136.

Heat system 112 may include, for example, without limitation, one or more ovens. First level of heat 134 may be a lower level of heat selected to cause the carbonization of plurality of filaments 120. For example, without limitation, first level of heat 134 may be between about 600 degrees Celsius and about 800 degrees Celsius. In some illustrative examples, first level of heat 134 may be between about 200 degrees Celsius and about 1000 degrees Celsius. In other illustrative examples, first level of heat 134 may be between about 1000 degrees Celsius and about 1600 degrees Celsius.

Tension system 110 is used to perform the tensioning of plurality of filaments 120. In one illustrative example, tensioning plurality of filaments 120 includes stretching plurality of filaments 120 in a manner that elongates each filament and reduces the diameter of each filament, but does not overly change the cross-sectional shape of each filament. For example, without limitation, plurality of filaments 120 may be stretched over series of rollers 139 to cause each of plurality of filaments 120 to become longer and thinner and band together plurality of filaments 120.

In this illustrative example, heat system 112 applies first level of heat 134 to plurality of filaments 120 prior to the tensioning of plurality of filaments 120 and during at least a portion of the time that plurality of filaments 120 is tensioned. In other illustrative examples, heat system 112 applies first level of heat 134 to plurality of filaments 120 after the tensioning of plurality of filaments 120.

Plurality of amorphous carbon fibers 135 may be further tensioned using tension system 110, while applying second level of heat 140 using heat system 112, to form plurality of graphitic carbon fibers 138. For example, amorphous carbon fiber 136 may be further tensioned, while applying second level of heat 140 to amorphous carbon fiber 135, to form graphitic carbon fiber 142. In some illustrative examples, a middle interior portion of graphitic carbon fiber 142 may remain amorphous.

This secondary tensioning and heating process may be performed in a manner similar to the first tensioning and heating process described above. However, amorphous carbon fiber 136 may be stretched with a greater amount of tension than applied to filament 121.

Further, second level of heat 140 may be a higher level of heat than first level of heat 134. In particular, second level of heat 140 may be selected to cause the graphitization of amorphous carbon fiber 136. For example, second level of heat 140 may be above 1000 degrees Celsius. In some cases, second level of heat 140 may be above 1200 degrees Celsius. In yet other illustrative examples, second level of heat 140 may be between about 1600 degrees Celsius and 3000 degrees Celsius.

The flattening of plurality of filaments 120 using roller system 108 reduces the thickness of each of plurality of filaments 120. Accordingly, the time needed for the heat produced by heat system 112 to penetrate through this thickness is reduced. Accordingly, the flattening of plurality of filaments 120 reduces the overall time needed to carbonize and graphitize plurality of filaments 120.

In some illustrative examples, heat system 112 may include set of ovens 141 for applying first level of heat 134 to plurality of filaments 120 and second level of heat 140 to plurality of amorphous carbon fibers 135, respectively. Set of ovens 141 may include one oven capable of switching between first level of heat 134 and second level of heat 140 or two ovens for providing these two different levels of heat. Similarly, tension system 110 may include set of tension devices 143 for applying a first amount of tension to plurality of filaments 120 and a second amount of tension to plurality of amorphous carbon fibers 135. Set of tension devices 143 may include one tension device for providing applying these different amounts of tension or multiple tension devices.

Because roller system 108 creates plurality of distinct surfaces 130 that are exposed on each filament of plurality of filaments 120, and thereby on each graphitic carbon fiber of plurality of graphitic carbon fibers 138, plurality of sizings 145 may be applied to each graphitic carbon fiber. For example, without limitation, plurality of sizings 145 may be applied to plurality of distinct surfaces 130 on graphitic carbon fiber 142. In one illustrative example, a different sizing may be applied to each distinct surface of graphitic carbon fiber 142. In other illustrative examples, each two distinct surfaces of graphitic carbon fiber 142 may be coated with at different sizings.

As one illustrative example, first sizing 144 may be applied to a first surface of graphitic carbon fiber 142. Further, second sizing 148 may be applied to a second surface of graphitic carbon fiber 142 using.

First sizing 144 and second sizing 148 are chemical treatments that protect the physical characteristics of graphitic carbon fiber 142. Further, these sizings may provide lubrication for ease of handling. Still further, these sizings may enable resin to bond to graphitic carbon fiber 142 more easily. First sizing 144 and second sizing 148 may be selected such that these two sizings are mutually attractive to prevent undesired twisting of graphitic carbon fiber 142. In one illustrative example, epoxy resin water-based sizings are used for both first sizing 144 and second sizing 148.

Applying two different sizings to graphitic carbon fiber 142 may allow graphitic carbon fiber 142 to be customized and may improve uniformity in any composite laminate that is created using graphitic carbon fiber 142. In particular, using two different epoxy sizings may chemically align the tetra-functional epoxy molecules as these molecules infiltrate the space between the filaments of graphitic carbon fiber, which may improve uniformity. A more uniform carbon fiber may allow a more uniform composite laminate to be fabricated, which may, in turn, decrease the amount of composite material that is needed, which may, in turn, decrease material and manufacturing costs and reduce weight.

Each of plurality of sizings 145 may be applied to graphitic carbon fiber 142 using one of plurality of surface sizing applicators 113. In particular, each of plurality of surface sizing applicators 113 may be configured for applying a sizing to one distinct surface. In other words, each of plurality of surface sizing applicators 113 may be a device for applying a sizing to a single surface or size of graphitic carbon fiber 142. Depending on the implementation, plurality of surface sizing applicators 113 may be used to apply plurality of sizings 145 to the various surfaces of plurality of distinct surfaces 130 of graphitic carbon fiber 142 simultaneously, serially, or at different times.

Plurality of surface sizing applicators 113 may be implemented in a number of different ways. For example, a surface sizing applicator of plurality of surface sizing applicators 113 may comprise at least one of sizing application roller 150, sizing application spray 152, sizing application brush 154, or chemical bath 155.

As used herein, the phrase "at least one of," when used with a list of items, means different combinations of one or more of the listed items may be used and only one of the items in the list may be needed. The item may be a particular object, thing, step, operation, process, or category. In other words, "at least one of" means any combination of items or number of items may be used from the list, but not all of the items in the list may be required.

For example, without limitation, "at least one of item A, item B, or item C" or "at least one of item A, item B, and item C" may mean item A; item A and item B; item B; item A, item B, and item C; item B and item C; or item A and C. In some cases, "at least one of item A, item B, or item C" or "at least one of item A, item B, and item C" may mean, but is not limited to, two of item A, one of item B, and ten of item C; four of item B and seven of item C; or some other suitable combination.

Sizing application roller 150 allows a sizing to be rolled onto a surface. Sizing application spray 152 allows a sizing to be sprayed onto a surface. Sizing application brush 154 allows a sizing to be brushed onto a surface. Further, chemical bath 155 allows a sizing to be applied to remaining surfaces after one of these other applicators has been used to apply a different sizing to a single surface. For example, one of sizing application roller 150, sizing application spray 152, and sizing application brush 154 may be used to apply a sizing to one surface. Chemical bath 155 may then be used to apply a different sizing to one or more other surfaces.

In some cases, both sizing application roller 150 and sizing application spray 152 may be used to apply two different sizings to two different surfaces of plurality of distinct surfaces 130. The application of the two different sizings may be performed simultaneously or at different times. In other cases, at least two different sizings may be applied to different portions of the same distinct surface. In this manner, depending on the implementation, two or more of the same type or different types of surface sizing applicators from plurality of surface sizing applicators 113 may be used to apply discrete sizings to at least two distinct surfaces of plurality of distinct surface 130 simultaneously or at different times.

In this manner, using roller system 108 to flatten cross-sectional shape 126 of filament 121 may improve the quality of graphitic carbon fiber 142 that is produced. Further, manufacturing carbon fibers 102 using the processes and systems described above may increase manufacturing efficiency and reduce manufacturing costs associated with composite manufacturing.

The illustration in FIG. 1 is not meant to imply physical or architectural limitations to the manner in which an illustrative embodiment may be implemented. Other components in addition to or in place of the ones illustrated may be used. Some components may be optional. Also, the blocks are presented to illustrate some functional components. One or more of these blocks may be combined, divided, or combined and divided into different blocks when implemented in an illustrative embodiment.

For example, in some cases, fiber processing system 104 may include oxidation system 156. Oxidation system 156 may be used to thermally oxidize plurality of filaments 120. In one illustrative example, oxidation system 156 may thermally oxidize plurality of filaments 120 in air at a temperature below about 300 degrees Celsius. Thermally oxidizing plurality of filaments 120 stabilizes plurality of filaments 120. The oxidation of plurality of filaments 120 may be performed prior to the carbonization of plurality of filaments 120. Depending on the implementation, the oxidation may be performed prior to or after the flattening of plurality of filament 120.

Figure 2:
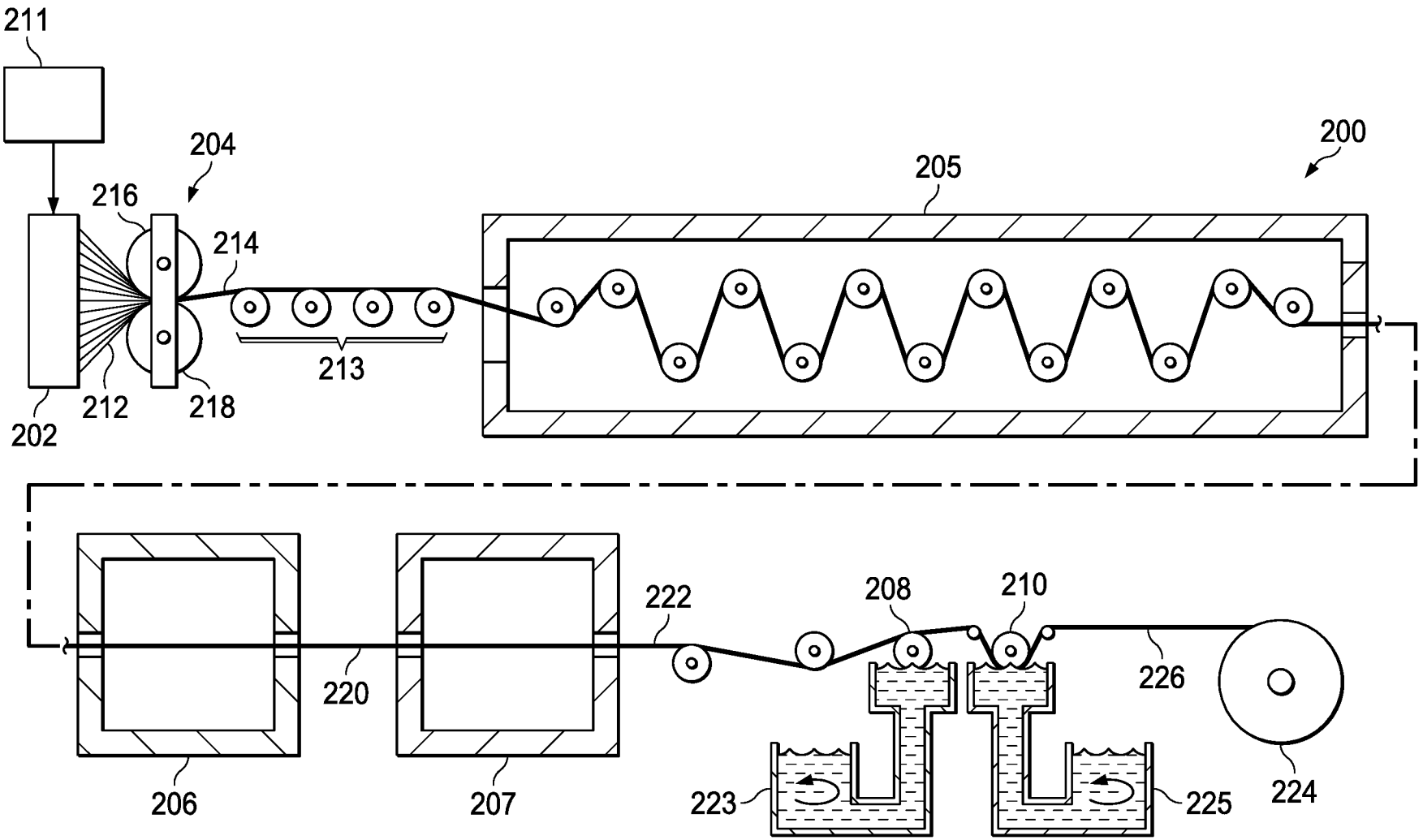
FIG. 2 is an illustration of a fiber processing system in accordance with an illustrative embodiment.

With reference now to FIG. 2, an illustration of a fiber processing system is depicted in accordance with an illustrative embodiment. Fiber processing system 200 may be an example of one implementation for fiber processing system 104 in FIG. 1.

As depicted, fiber processing system 200 includes output system 202, roller system 204, oxidation system 205, carbonization system 206, graphitization system 207, first sizing application roller 208, and second sizing application roller 210. In this illustrative example, output system 202 and roller system 204 may be examples of implementations for output system 106, roller system 108, respectively, in FIG. 1. First sizing application roller 208 and second sizing application roller 210 may be an example of one implementation for plurality of surface sizing applicators 113 in FIG. 1.

As depicted, polymer 211 is extruded through output system 202 and forced out of output system 202 as plurality of filaments 212. Plurality of filaments 212 may be an example of one implementation for plurality of filaments 120 in FIG. 1. In this illustrative example, plurality of filaments 212 may be collectively referred to as PAN fibers 214. Further, each of plurality of filaments 212 may have a substantially cylindrical shape, such that each filament has a cross-sectional shape that is substantially circular.

Roller system 204 receives plurality of filaments 212 and applies pressure to plurality of filaments to change a cross-sectional shape of each of plurality of filaments 212 and create a plurality of distinct surfaces on each filament. As depicted, roller system 204 may include first roller 216 and second roller 218. Passing plurality of filaments 212 between first roller 216 and second roller 218 flattens the cross-sectional shape of plurality of filaments 212. For example, the substantially circular cross-sectional shape of each of plurality of filaments 212 may be changed to substantially oval, elliptical, or rectangular with rounded corners.

In this illustrative example, flattening plurality of filaments 212 between first roller 216 and second roller 218 creates a plurality of distinct surfaces for each of plurality of filaments 212. For example, flattening each filament may create a plurality of edges that define a plurality of distinct surfaces, which may include a top surface and a bottom surface for. The edges defining the plurality of distinct surfaces may be rounded or sharp, depending on the extent and type of flattening performed. Further, flattening plurality of filaments 212 may create more exposed surface area compared to when each of plurality of filaments 212 has a cylindrical shape.

In some illustrative examples, plurality of filaments 212 may be stretched prior to being received by oxidation system 205. For example, without limitation, fiber processing system 200 may also include tension system 213 for stretching plurality of filaments 212. In one illustrative example, tension system 213 includes a series of rollers (not shown) that may be used to stretch plurality of filaments 212 to make each filament longer and thinner without overly changing the cross-sectional shape of each filament.

Oxidation system 205 may receive PAN fibers 214 after plurality of filaments 212 has been stretched. Oxidation system 205 may thermally oxidize PAN fibers 214.

Thereafter, carbonization system 206 carbonizes PAN fibers 214 to form amorphous carbon fibers 220. Amorphous carbon fibers 220 may be an example of one implementation for plurality of amorphous carbon fibers 135 in FIG. 1. In one illustrative example, carbonization system 206 may include an oven that applies a first level of heat having a temperature selected to carbonize PAN fibers 214.

Graphitization system 207 graphitizes amorphous carbon fibers 220 by applying a second level of heat to amorphous carbon fibers 220. The second level of heat may be higher than the first level of heat applied by carbonization system 206 and may be selected to graphitize amorphous carbon fibers 220. Graphitic carbon fibers 222 may be an example of one implementation for plurality of graphitic carbon fibers 138 in FIG. 1.

Thereafter, a first sizing is applied to graphitic carbon fiber 222 by running first sizing application roller 208 over the top surfaces of graphitic carbon fibers 222. In particular, first sizing application roller 208 may pick up the sizing from chemical bath 223 and apply this sizing to the top surfaces of graphitic carbon fibers 222 as first sizing application roller 208 runs over these top surfaces. The first sizing may be formulated to protect the physical properties of graphitic carbon fiber 222 and prepare graphitic carbon fiber 222 for combination with other materials.

Additionally, a second sizing is applied to graphitic carbon fiber 222 by running second sizing application roller 210 over the bottom surfaces of graphitic carbon fiber 222. In particular, second sizing application roller 210 may pick up the sizing from chemical path 225 and apply this sizing to the bottom surfaces of graphitic carbon fibers 222 as second sizing application roller 210 runs over these bottom surfaces. The second sizing may be formulated to protect the physical properties of graphitic carbon fiber 222 and prepare graphitic carbon fiber 222 for combination with other materials.

Once the first sizing and the second sizing have been applied to graphitic carbon fibers 222, these graphitic carbon fibers 222 may be spun around spool 224 to form carbon tow 226. Carbon tow 226 may be used to fabricate composite laminates.

The illustration of fiber processing system 200 in FIG. 2 is not meant to imply physical or architectural limitations to the manner in which an illustrative embodiment may be implemented. Other components in addition to or in place of the ones illustrated may be used. Some components may be optional.

The different components shown in FIG. 2 may be illustrative examples of how components shown in block form in FIG. 1 can be implemented as physical structures. Additionally, some of the components in FIG. 2 may be combined with components in FIG. 1, used with components in FIG. 1, or a combination of the two.

Figure 3:
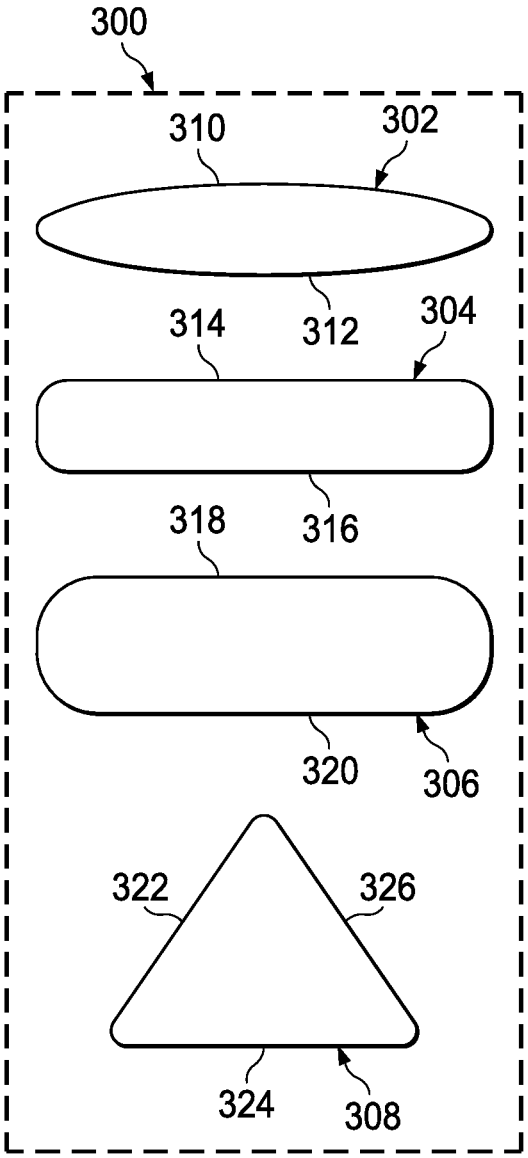
FIG. 3 is an illustration of a group of cross-sectional shapes for a flattened filament in accordance with an illustrative embodiment.

With reference now to FIG. 3, an illustration of a group of cross-sectional shapes for a flattened filament is depicted in accordance with an illustrative example. Group of cross-sectional shapes 300 may include potential cross-sectional shapes for a filament, such as filament 121 in FIG. 1, after the filament has been flattened by a roller system, such as roller system 108 in FIG. 1.

As depicted, group of cross-sectional shapes 300 may include first shape 302, second shape 304, third shape 306, and fourth shape 308. Although only four potential cross-sectional shapes are depicted, group of cross-sectional shapes 300 may include other potential shapes, depending on the implementation.

First shape 302 may be an elliptical shape that defines first surface 310 and second surface 312. Second shape 304 may be a rectangular shape with edges that define first surface 314 and second surface 316. Third shape 306 may be another rectangular shape with even more rounded edges that define first surface 318 and second surface 320. Fourth shape 308 may be a triangular shape that defines first surface 322, second surface 324, and third surface 326.

In this manner, a filament, such as filament 121 in FIG. 1, may be flattened to form various shapes. Filaments with these types of shapes may be converted into carbon fibers that can be more densely packed in composite manufacturing as compared to filaments with substantially circular cross-sectional shapes. Further, with the type of potential shapes included in group of cross-sectional shapes 300, different sizings may be easily applied to distinct surfaces of the carbon fibers.

Figure 4:
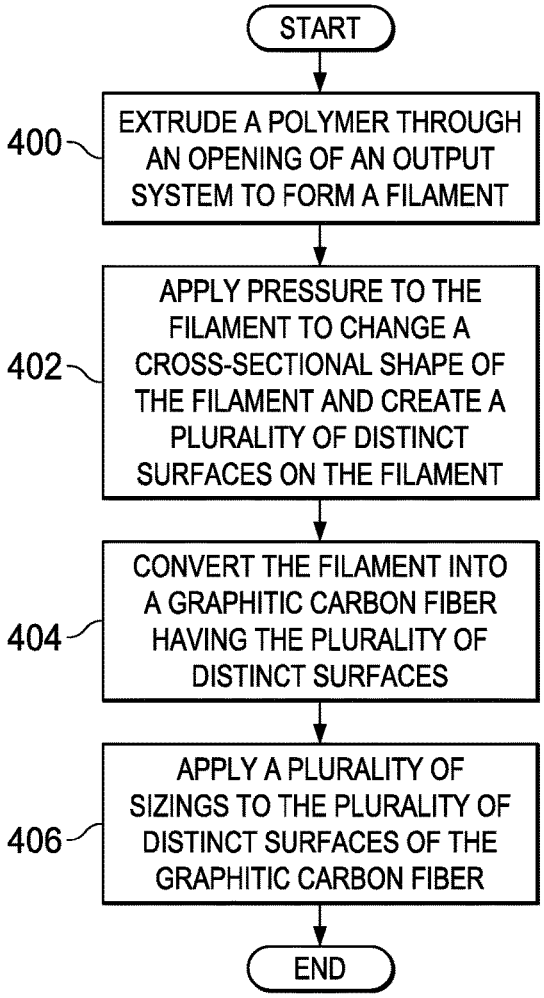
FIG. 4 is a flowchart of a process for manufacturing a carbon fiber in accordance with an illustrative embodiment.

With reference now to FIG. 4, an illustration of a process for manufacturing a carbon fiber is depicted in the form of a flowchart in accordance with an illustrative embodiment. The process illustrated in FIG. 4 may be implemented using fiber processing system 104 in FIG. 1 or fiber processing system 200 described in FIG. 2.

The process may begin by extruding a polymer through an opening of an output system to form a filament (operation 400). In this illustrative example, the polymer may be polyacrylonitrile. The filament forms in operation 400 may have a cylindrical shape with a cross-sectional shape that is substantially circular. Thus, the filament may have a single continuous outer surface.

Next, pressure is applied to the filament to change a cross-sectional shape of the filament and create a plurality of distinct surfaces on the filament (operation 402). In particular, in operation 402, the filament may be flattened. In other words, the cross-sectional shape of the filament may be changed from substantially circular to substantially oval, elliptical, rectangular with rounded corners, or some other type of cross-sectional shape that defines a plurality of distinct surfaces. The plurality of distinct surfaces may be defined by edges that are rounded or sharp, depending on the extent and type of flattening performed in operation 402.

Thereafter, the filament may be converted into a graphitic carbon fiber having the plurality of distinct surfaces (operation 404). Next, a plurality of sizings is applied to the plurality of distinct surfaces of the graphitic carbon fiber (operation 406), with the process terminating thereafter. In operation 406, at least two of the distinct surfaces of the graphitic carbon fiber may be coated with two different sizings. In one illustrative example, a different sizing is applied to each distinct surface of the graphitic carbon fiber. For example, without limitation, a first sizing may be applied to a top surface of the graphitic carbon fiber, while a second sizing may be applied to the bottom surface of the graphitic carbon fiber.

Figure 5:
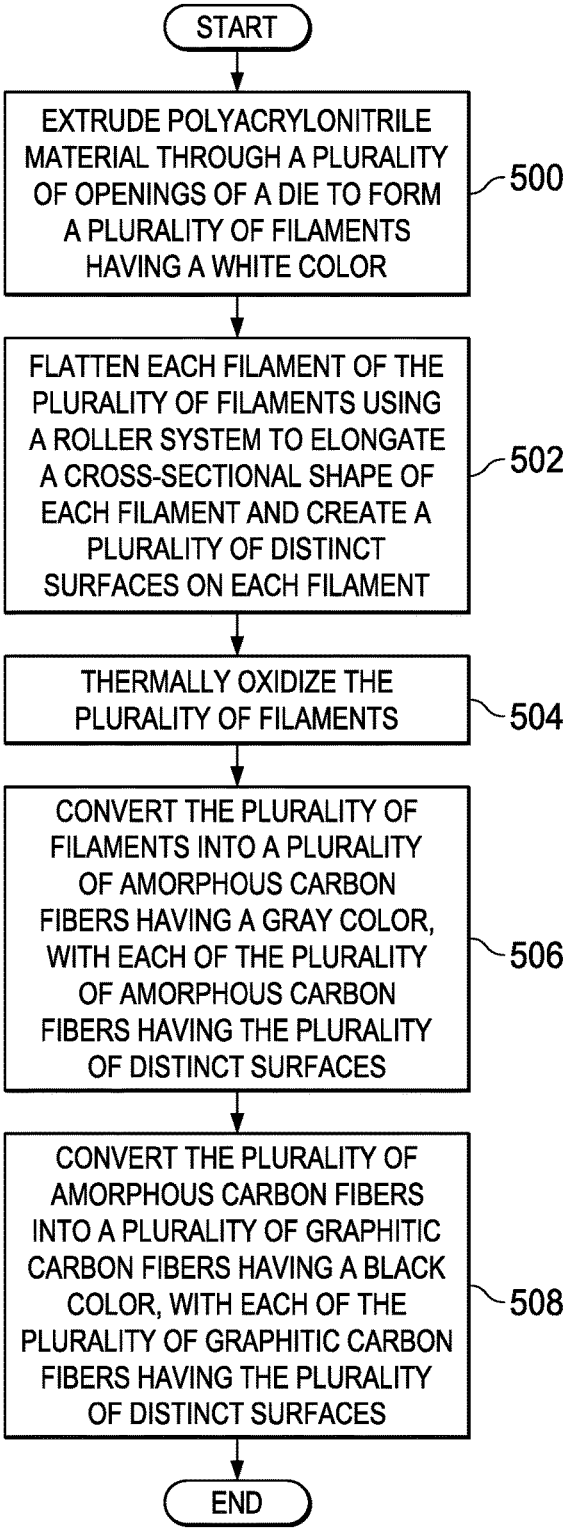
FIG. 5 is a flowchart of a process for manufacturing carbon fibers in accordance with an illustrative embodiment.

With reference now to FIG. 5, an illustration of a process for manufacturing carbon fibers is depicted in the form of a flowchart in accordance with an illustrative embodiment. The process illustrated in FIG. 5 may be implemented using fiber processing system 104 in FIG. 1 or fiber processing system 200 described in FIG. 2.

The process may begin by extruding polyacrylonitrile material through a plurality of openings of a die to form a plurality of filaments having a white color (operation 500). In operation 500, the plurality of filaments may also be referred to as a plurality of PAN filaments.

Next, each filament of the plurality of filaments may be flattened using a roller system to elongate a cross-sectional shape of each filament and create a plurality of distinct surfaces on each filament (operation 502). In operation 502, the cross-sectional shape of each filament may be changed from a substantially circular shape to a substantially oval, elliptical, or rectangular shape with rounded corners. In some illustrative examples, in operation 502, the plurality of filaments may be passed between a first set of rollers and a second set of rollers. The flattening of the plurality of filaments in operation 502 increases the exposed surface area of the plurality of filaments. Further, the flattening of the plurality of filaments creates edges that define a plurality of distinct surfaces. These edges may be rounded or sharp.

Then, the plurality of filaments may be thermally oxidized (operation 504). In operation 504, the plurality of filaments may be thermally oxidized at a lower level of heat than the level of heat needed to carbonize the plurality of filaments. For example, the plurality of filaments may be oxidized at less than about 400 degrees Celsius.

Thereafter, the plurality of filaments may be converted into a plurality of amorphous carbon fibers having a gray color, with each of the plurality of amorphous carbon fibers having the plurality of distinct surfaces (operation 504). Operation 504 may be performed using a tension system that stretches the plurality of filaments and a heat system that heats the plurality of filaments. In operation 504, the plurality of filaments may be made longer and thinner by the stretching. Stretching the plurality of filaments may cause the various filaments to band together. Flattening the plurality of filaments prior to the stretching enables the plurality of filaments to form a more densely packed band of filaments. In operation 504, the plurality of filaments may be heated at a first level of heat selected to carbonize the plurality of filaments and form the plurality of amorphous carbon fibers.

Next, the plurality of amorphous carbon fibers may be converted into a plurality of graphitic carbon fibers having a black color, with each of the plurality of graphitic carbon fibers having the plurality of distinct surfaces (operation 506). Operation 506 may be performed in a manner similar to operation 506, but the plurality of amorphous carbon fibers may be heated at a second level of heat that is higher than the first level of heat to cause graphitization.

Thereafter, a plurality of sizings may be applied to each graphitic carbon fiber of the plurality of graphitic carbon fibers (operation 508), with the process terminating thereafter. In operation 508, a different sizing may be applied to each different distinct surface of each graphitic carbon fiber. For example, without limitation, a first sizing may be applied to the top surfaces of the plurality of graphitic carbon fibers, while a second sizing may be applied to the bottom surfaces of the plurality of graphitic carbon fibers.

Figure 6:
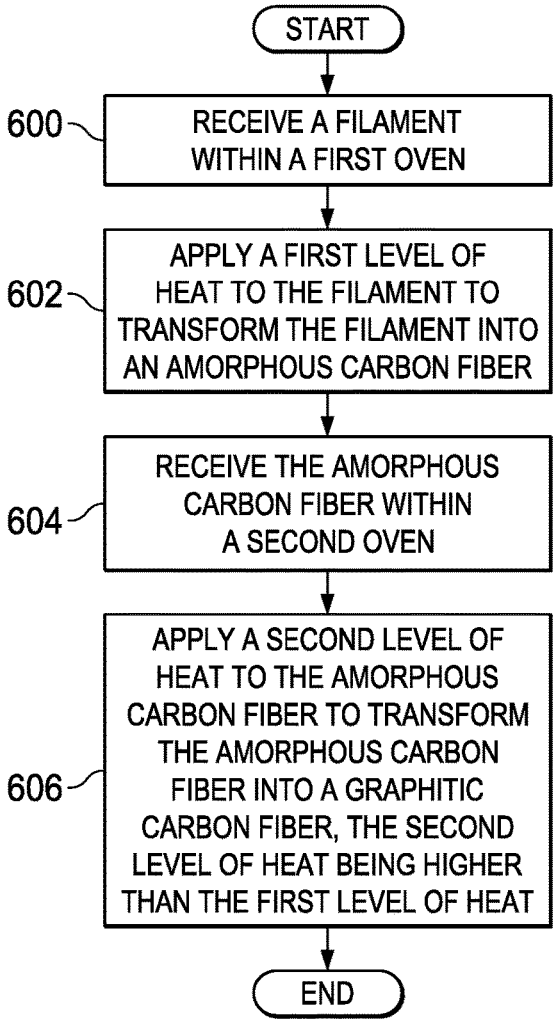
FIG. 6 is a flowchart of a process for transforming a plurality of filaments into a plurality of graphitic carbon fibers in accordance with an illustrative embodiment.

With reference now to FIG. 6, an illustration of a process for transforming a plurality of filaments into a graphitic carbon fiber is depicted in the form of a flowchart in accordance with an illustrative embodiment. The process illustrated in FIG. 6 may be implemented using fiber processing system 104 in FIG. 1 or fiber processing system 200 described in FIG. 2.

The process may begin by receiving a filament within a first oven (operation 600). A first level of heat is applied to the filament to transform the filament into an amorphous carbon fiber (operation 602).

Thereafter, the amorphous carbon fiber is received within a second oven (operation 604). A second level of heat is applied to the amorphous carbon fiber to transform the amorphous carbon fiber into a graphitic carbon fiber, the second level of heat being higher than the first level of heat (operation 606), with the process terminating thereafter.

Figure 7:
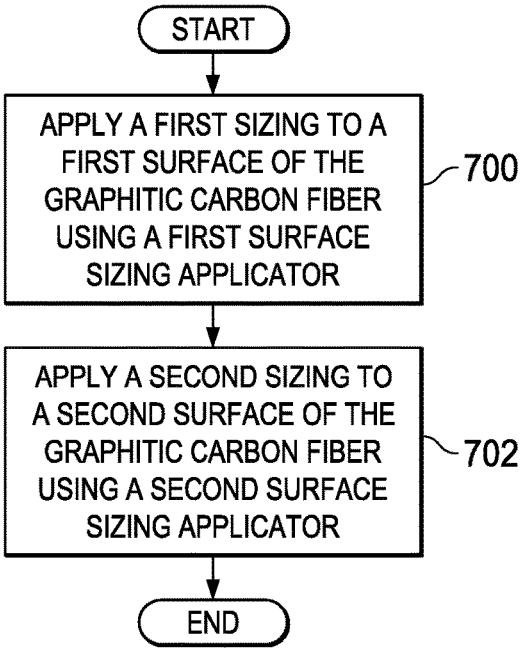
FIG. 7 is a flowchart of a process for applying sizings to a graphitic carbon fiber in accordance with an illustrative embodiment.

With reference now to FIG. 7, an illustration of a process for applying sizings to a graphitic carbon fiber is depicted in the form of a flowchart in accordance with an illustrative embodiment. The process illustrated in FIG. 7 may be implemented using fiber processing system 104 in FIG. 1 or fiber processing system 200 described in FIG. 2.

The process may begin by applying a first sizing to a first surface of the graphitic carbon fiber using a first surface sizing applicator (operation 700). In operation 700, the first surface sizing applicator may take the form of, for example, without limitation, a sizing application roller, a sizing application spray, a sizing application brush, or some other type of application device that enables the first sizing to be applied to a single surface of the graphitic carbon fiber.

Next, a second sizing may be applied to a second surface of the graphitic carbon fiber using a second surface sizing applicator (operation 702), with the process terminating thereafter. In operation 702, the second surface sizing applicator may take the form of, for example, without limitation, a sizing application roller, a sizing application spray, a sizing application brush, a chemical bath, or some other type of application device that enables the first sizing to be applied to a different surface of the graphitic carbon fiber, without affecting the first sizing that has already been applied to the graphitic carbon fiber.

The flowcharts and block diagrams in the different depicted embodiments illustrate the design, architecture, and functionality of some possible implementations of apparatuses and methods in an illustrative embodiment. In this regard, each block in the flowcharts or block diagrams may represent a module, a segment, a function, and/or a portion of an operation or step.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

Figure 8:
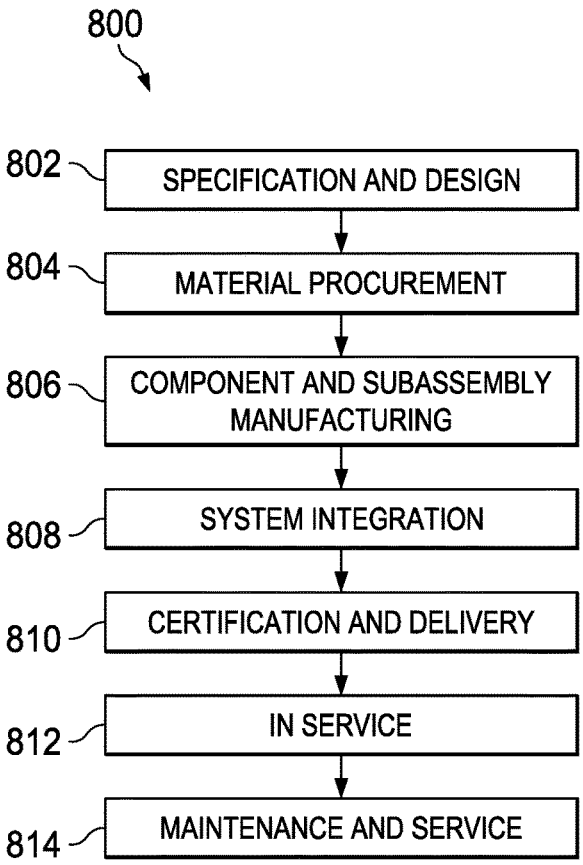
FIG. 8 is a flowchart of an aircraft manufacturing and service method in accordance with an illustrative embodiment.

Illustrative embodiments of the disclosure may be described in the context of aircraft manufacturing and service method 800 as shown in FIG. 8 and aircraft 900 as shown in 9. Turning first to FIG. 8, a flowchart of an aircraft manufacturing and service method is depicted in accordance with an illustrative embodiment. During pre-production, aircraft manufacturing and service method 800 may include specification and design 802 of aircraft 900 in 9 and material procurement 804.

During production, component and subassembly manufacturing 806 and system integration 808 of aircraft 900 in 9 takes place. Thereafter, aircraft 900 in FIG. 9 may go through certification and delivery 810 in order to be placed in service 812. While in service 812 by a customer, aircraft 900 in FIG. 9 is scheduled for routine maintenance and service 814, which may include modification, repair, refurbishment, and other maintenance or service.

Each of the processes of aircraft manufacturing and service method 800 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of vendors, subcontractors, and suppliers; and an operator may be an airline, a leasing company, a military entity, a service organization, and so on.

Figure 9:
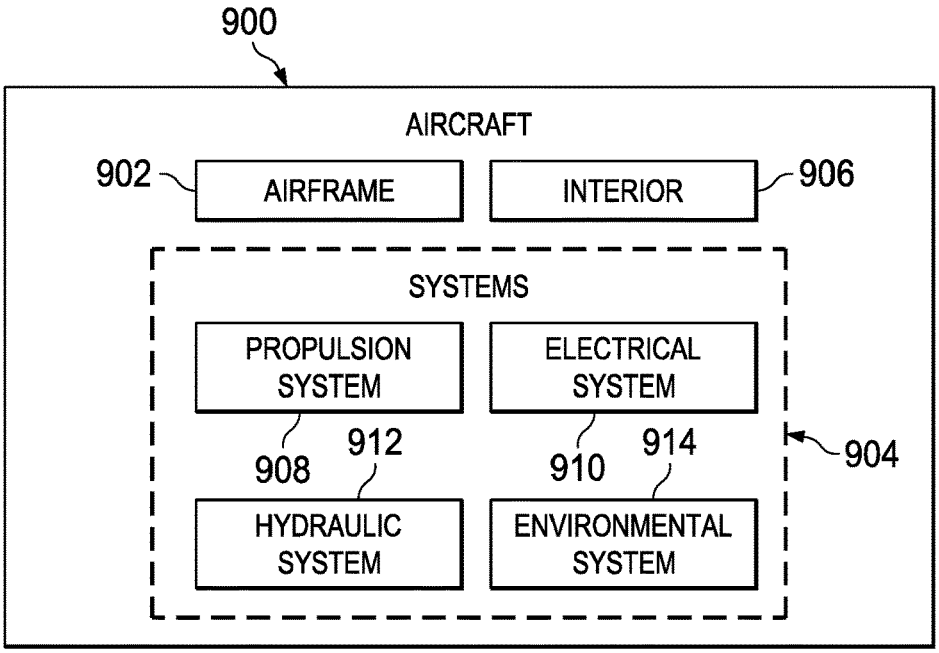
FIG. 9 is a block diagram of an aircraft in accordance with an illustrative embodiment.

With reference now to FIG. 9, a block diagram of an aircraft is depicted in which an illustrative embodiment may be implemented. In this example, aircraft 900 is produced by aircraft manufacturing and service method 800 in FIG. 8 and may include airframe 902 with plurality of systems 904 and interior 906. Examples of systems 904 include one or more of propulsion system 908, electrical system 910, hydraulic system 912, and environmental system 914. Any number of other systems may be included. Although an aerospace example is shown, different illustrative embodiments may be applied to other industries, such as the automotive industry.

Apparatuses and methods embodied herein may be employed during at least one of the stages of aircraft manufacturing and service method 800 in FIG. 8. In particular, fiber processing system 104 described in FIG. 1 and fiber processing system 200 described in FIG. 2 may be used to manufacture carbon fibers 102 during any one of the stages of aircraft manufacturing and service method 800. For example, without limitation, these systems may be used to manufacture carbon fibers 102 for use in the fabrication of composites during at least one of specification and design 802, material procurement 804, component and subassembly manufacturing 806, system integration 808, routine maintenance and service 814, or some other stage of aircraft manufacturing and service method 800. The composites may be used in the assembly of any part of sub-part of aircraft 900, including airframe 902 and interior 906.

In one illustrative example, components or subassemblies produced in component and subassembly manufacturing 806 in FIG. 8 may be fabricated or manufactured in a manner similar to components or subassemblies produced while aircraft 900 is in service 1 in FIG. 8. As yet another example, one or more apparatus embodiments, method embodiments, or a combination thereof may be utilized during production stages, such as component and subassembly manufacturing 806 and system integration 808 in FIG. 8. One or more apparatus embodiments, method embodiments, or a combination thereof may be utilized while aircraft 900 is in service 812 and/or during maintenance and service 814 in FIG. 8. The use of a number of the different illustrative embodiments may substantially expedite the assembly of and/or reduce the cost of aircraft 900.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other desirable embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a roller system for applying pressure to a filament to change a cross-sectional shape of the filament and create a plurality of distinct surfaces;

a heat system for converting the filament into a graphitic carbon fiber; and a plurality of surface sizing applicators for applying a plurality of sizings to the plurality of distinct surfaces of the graphitic carbon fiber, the plurality of surface sizing applicators comprising at least:

a first sizing applicator configured to apply a first sizing of the plurality of sizings to a first surface of the plurality of distinct surfaces of the graphitic carbon fiber, and a second sizing applicator configured to apply a second sizing of the plurality of sizings to a second surface of the plurality of distinct surfaces of the graphitic carbon fiber, the second sizing being different from the first sizing.

2. The apparatus of claim 1, wherein a surface sizing applicator in the plurality of surface sizing applicators includes at least one of a sizing application roller, a sizing application spray, a sizing application brush, a chemical bath.

3. The apparatus of claim 1 further comprising:

a tension system for tensioning the filament at least one of prior to heating the filament, while heating the filament, or after heating the filament.

4. The apparatus of claim 1, wherein the first and second surface sizing applicators are configured to apply the first and second sizings to the first and second surfaces of the graphitic carbon fiber simultaneously.

5. The apparatus of claim 1, wherein:

the first surface sizing applicator is configured to apply the first sizing on a top surface of the graphitic carbon fiber; and the second surface sizing applicator is configured to apply the second sizing on a bottom surface of the graphitic carbon fiber.

6. The apparatus of claim 1, wherein the heat system uses a first level of heat to convert the filament into an amorphous carbon fiber and a second level of heat to convert the filament into a graphitic carbon fiber.

7. The apparatus of claim 6, wherein the amorphous carbon fiber has a gray color and wherein the graphitic carbon fiber has a black color.

8. The apparatus of claim 6, wherein a middle interior portion of the graphitic carbon fiber remains amorphous.

9. The apparatus of claim 1, wherein the filament is comprised of a polyacrylonitrile polymer.

10. The apparatus of claim 1, wherein the roller system comprises at least one roller having a powder coating to protect the filament and to prevent the filament from sticking to the roller system.

11. The apparatus of claim 1, wherein the heat system comprises:

a first oven for heating the filament at a first level of heat to form an amorphous carbon fiber; and a second oven for heating the filament at a second level of heat to form the graphitic carbon fiber.

12. The apparatus of claim 1 further comprising:

an output system having an opening through which a polymer is extruded to form the filament.

13. The apparatus of claim 1, wherein the first and second surface sizing applicators are sizing application rollers.

14. The apparatus of claim 1, wherein:

the first surface sizing applicator comprises a first chemical bath for holding the first sizing and contacting the first surface of the graphitic carbon fiber with the first sizing; and the second surface sizing applicator comprises a second chemical bath for holding the second sizing and contacting the second surface of the graphitic carbon fiber with the second sizing.

15. The apparatus of claim 14, wherein the first sizing and the second sizing are mutually attractive to prevent undesired twisting of the graphitic carbon fiber.

16. The apparatus of claim 1, wherein the first and second sizings include respective two different epoxy resins and wherein using the two different epoxy resins enables chemical alignment of tetra-functional epoxy molecules in the two different epoxy resins to improve a uniformity of the graphitic carbon fiber.

17. An apparatus comprising:

a roller system for applying pressure to a filament to change a cross-sectional shape of the filament and create a plurality of distinct surfaces;

a heat system for converting the filament into a graphitic carbon fiber; and a plurality of surface sizing applicators for applying a plurality of sizings to the plurality of distinct surfaces of the graphitic carbon fiber such that each sizing of the at least two different sizings contacts a respective distinct surface of the plurality of distinct surfaces of the graphitic carbon fiber;

wherein the plurality of surface sizing applicators comprises:

a first sizing applicator configured to apply a first sizing of the at least two different sizings to a respective first distinct surface of the plurality of distinct surfaces, and a second sizing applicator configured to apply a second sizing of the at least two different sizings to a respective second distinct surface of the plurality of distinct surfaces, the second sizing being different from the first sizing.

18. The apparatus of claim 17, wherein the at least two different sizings include two different epoxy resins and wherein using the two different epoxy resins enables chemical alignment of tetra-functional epoxy molecules in the two different epoxy resins to improve a uniformity of the graphitic carbon fiber.

19. The apparatus of claim 17, wherein the first sizing and the second sizing are mutually attractive to prevent undesired twisting of the graphitic carbon fiber.

20. A fiber processing system comprising:

a first chemical bath that includes a first sizing;

a second chemical bath that includes a second sizing that is different from the first sizing;

a first surface sizing applicator for picking up the first sizing from the first chemical bath to apply the first sizing to a first surface but not a second surface of a graphitic carbon fiber; and a second surface sizing applicator for picking up the second sizing from the second chemical bath to apply the second sizing to the second surface of the graphitic carbon fiber.

* * * * *